US010785567B1

(12) United States Patent
Roche et al.

(10) Patent No.: US 10,785,567 B1
(45) Date of Patent: Sep. 22, 2020

(54) FABRICATION OF PIEZOELECTRIC TRANSDUCER INCLUDING INTEGRATED TEMPERATURE SENSOR

(71) Applicant: Cirrus Logic International Semiconductor Ltd., Edinburgh (GB)

(72) Inventors: Nicholas Roche, Edinburgh (GB); Anthony S. Doy, Los Gatos, CA (US); Itisha Tyagi, Austin, TX (US)

(73) Assignee: Cirrus Logic, Inc., Austin, TX (US)

( * ) Notice: Subject to any disclaimer, the term of this patent is extended or adjusted under 35 U.S.C. 154(b) by 0 days.

(21) Appl. No.: 16/903,044

(22) Filed: Jun. 16, 2020

Related U.S. Application Data

(62) Division of application No. 16/287,235, filed on Feb. 27, 2019.

(60) Provisional application No. 62/635,899, filed on Feb. 27, 2018.

(51) Int. Cl.
*H04R 3/00* (2006.01)
*H04R 17/00* (2006.01)
*H04R 29/00* (2006.01)

(52) U.S. Cl.
CPC ..... *H04R 3/007* (2013.01); *H04R 17/00* (2013.01); *H04R 29/001* (2013.01)

(58) Field of Classification Search
None
See application file for complete search history.

(56) References Cited

U.S. PATENT DOCUMENTS

2013/0108061 A1* 5/2013 Ando ..... G06F 3/0433 381/55
2014/0184878 A1 7/2014 Watanabe et al.
2014/0265724 A1 9/2014 Aida et al.
2016/0365502 A1 12/2016 Saito et al.
2017/0006394 A1 1/2017 Risberg et al.
2018/0136899 A1 5/2018 Risberg et al.

* cited by examiner

*Primary Examiner* — Paul W Huber
(74) *Attorney, Agent, or Firm* — Jackson Walker L.L.P.

(57) ABSTRACT

A method of fabricating a piezoelectric transducer may include interleaving a plurality of layers of piezoelectric material with a plurality of conductive layers including a first conductive layer, one or more second conductive layers, and one or more third conductive layers, coupling the first conductive layer to a first electrode, wherein an electrical impedance of the first conductive layer varies as a function of a temperature internal to the piezoelectric transducer, and such that a measurement signal indicative of the electrical impedance is generated at the first electrode, coupling the one or more second conductive layers to a second electrode, and coupling the one or more third conductive layers to a third electrode, such that an electrical driving signal driven to the second electrode and the third electrode causes mechanical vibration of the piezoelectric transducer as a function of the electrical driving signal.

21 Claims, 6 Drawing Sheets

FABRICATION OF PIEZOELECTRIC TRANSDUCER INCLUDING INTEGRATED TEMPERATURE SENSOR

RELATED APPLICATIONS

The present disclosure is a divisional of U.S. Non-Provisional patent application Ser. No. 16/287,235, filed Feb. 27, 2019, which claims priority to U.S. Provisional Patent Application Ser. No. 62/635,899, filed Feb. 27, 2018, each of which is incorporated by reference herein in its entirety.

FIELD OF DISCLOSURE

The present disclosure relates in general to a mobile device, and more particularly, to thermally protecting a capacitive load and an amplifier driving the capacitive load.

BACKGROUND

A piezoelectric transducer may be used to generate full audio band acoustic signals by coupling the piezoelectric transducer to a suitable surface that acts as a loudspeaker. Accordingly, consumer electronic products with large display screens such as smartphones, tablets, personal computers, and televisions may benefit from adopting piezoelectric transducers as audio transducers that mechanically drive a screen. The large screen area may move a large mass of air thereby increasing loudness and bass response. As the piezoelectric transducer may be mounted behind the screen, there may be no requirement for an opening or acoustic port in the screen or body of the consumer electronic product, as is the case with traditional approaches, enabling more surface to be dedicated to display and simplifying waterproof device designs.

Piezoelectric transducers present a mostly capacitive impedance at audio frequencies (e.g., 20 Hz-20 KHz) with a small resistive component in series with the capacitive impedance. At higher audio frequencies, a reduced impedance may cause high currents to flow which, in turn, may cause self-heating in a piezoelectric transducer. The self-heating may be a function of an electrical impedance of the piezoelectric transducer, the frequency and voltage of the electrical signal driving the piezoelectric transducer, mechanical mounting of the piezoelectric transducer and the resultant force induced, and a thermal resistance of the enclosure around the piezoelectric transducer. The temperature of a piezoelectric transducer is therefore difficult to predict for a given mounting, enclosure, and drive signal.

Below a temperature known as the Curie temperature, characteristics of a piezoelectric material, such as the charge constant, voltage constant, and permittivity all vary with temperature which may introduce dynamic non-linearity into a transfer function of the piezoelectric transducer. Above the Curie temperature, piezoelectric material may depolarize, potentially causing mechanical and acoustic properties to be permanently degraded or lost.

It is therefore desirable to measure and control the self-heating within a piezoelectric transducer when driving audio signals. While existing temperature sensors may permit sensing a temperature proximate to, but external to, a piezoelectric transducer, existing approaches are not effective in measuring temperatures internal to a piezoelectric transducer.

SUMMARY

In accordance with the teachings of the present disclosure, the disadvantages and problems associated with measuring temperature caused by self-heating in a piezoelectric transducer may be reduced or eliminated.

In accordance with embodiments of the present disclosure, a method of fabricating a piezoelectric transducer may include interleaving a plurality of layers of piezoelectric material with a plurality of conductive layers including a first conductive layer, one or more second conductive layers, and one or more third conductive layers, coupling the first conductive layer to a first electrode, wherein an electrical impedance of the first conductive layer varies as a function of a temperature internal to the piezoelectric transducer, and such that a measurement signal indicative of the electrical impedance is generated at the first electrode, coupling the one or more second conductive layers to a second electrode, and coupling the one or more third conductive layers to a third electrode, such that an electrical driving signal driven to the second electrode and the third electrode causes mechanical vibration of the piezoelectric transducer as a function of the electrical driving signal.

In accordance with these and other embodiments of the present disclosure, a method may include receiving a measurement signal indicative of a temperature internal to a piezoelectric transducer from a first electrode coupled to a first conductive layer of the piezoelectric transducer, wherein the piezoelectric transducer comprises a plurality of layers of piezoelectric material interleaved with a plurality of conductive layers including the first conductive layer, one or more second conductive layers coupled to a second electrode, and one or more third conductive layers coupled to a third electrode wherein an electrical driving signal driven to the second electrode and the third electrode causes mechanical vibration of the piezoelectric transducer as a function of the electrical driving signal. The method may also include controlling the electrical driving signal in order to maintain the temperature internal to the piezoelectric transducer at a desired temperature or desired temperature range.

In accordance with these and other embodiments of the present disclosure, a piezoelectric transducer may include an interleaved plurality of layers of piezoelectric material with a plurality of conductive layers including a first conductive layer, one or more second conductive layers, and one or more third conductive layers, a first electrode coupled to the first conductive layer, wherein an electrical impedance of the first conductive layer varies as a function of a temperature internal to the piezoelectric transducer, and such that a measurement signal indicative of the electrical impedance is generated at the first electrode, a second electrode coupled to the one or more second conductive layers, and a third electrode coupled to the one or more third conductive layers, such that an electrical driving signal driven to the second electrode and the third electrode causes mechanical vibration of the piezoelectric transducer as a function of the electrical driving signal.

In accordance with these and other embodiments of the present disclosure, a system may include an input configured to receive a measurement signal indicative of a temperature internal to a piezoelectric transducer from a first electrode coupled to a first conductive layer of the piezoelectric transducer, wherein the piezoelectric transducer comprises a plurality of layers of piezoelectric material interleaved with a plurality of conductive layers including the first conductive layer, one or more second conductive layers coupled to a second electrode, and one or more third conductive layers coupled to a third electrode wherein an electrical driving signal driven to the second electrode and the third electrode causes mechanical vibration of the piezoelectric transducer as a function of the electrical driving signal. The system may further include control circuitry configured to control the electrical driving signal in order to maintain the temperature internal to the piezoelectric transducer at a desired temperature or desired temperature range.

Technical advantages of the present disclosure may be readily apparent to one having ordinary skill in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1A:
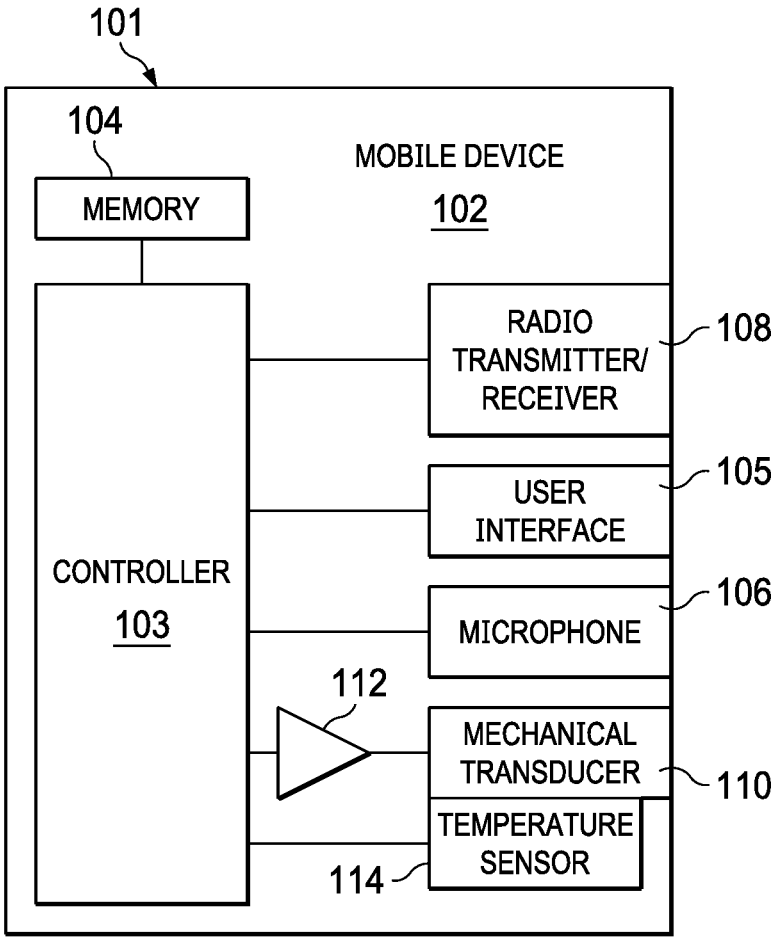
FIG. 1A illustrates a block diagram of selected components of an example mobile device, in accordance with embodiments of the present disclosure.

FIG. 1A illustrates a block diagram of selected components of an example mobile device 102, in accordance with embodiments of the present disclosure. As shown in FIG. 1A, mobile device 102 may comprise an enclosure 101, a controller 103, a memory 104, a user interface 105, a microphone 106, a radio transmitter/receiver 108, a mechanical transducer 110, an amplifier 112, and an integrated temperature sensor 114.

Enclosure 101 may comprise any suitable housing, casing, or other enclosure for housing the various components of mobile device 102. Enclosure 101 may be constructed from plastic, metal, and/or any other suitable materials. In addition, enclosure 101 may be adapted (e.g., sized and shaped) such that mobile device 102 is readily transported on a person of a user of mobile device 102. Accordingly, mobile device 102 may include but is not limited to a smart phone, a tablet computing device, a handheld computing device, a personal digital assistant, a notebook computer, or any other device that may be readily transported on a person of a user of mobile device 102.

Controller 103 is housed within enclosure 101 and may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, controller 103 may interpret and/or execute program instructions and/or process data stored in memory 104 and/or other computer-readable media accessible to controller 103.

Memory 104 may be housed within enclosure 101, may be communicatively coupled to controller 103, and may include any system, device, or apparatus configured to retain program instructions and/or data for a period of time (e.g., computer-readable media). Memory 104 may include random access memory (RAM), electrically erasable programmable read-only memory (EEPROM), a Personal Computer Memory Card International Association (PCMCIA) card, flash memory, magnetic storage, opto-magnetic storage, or any suitable selection and/or array of volatile or non-volatile memory that retains data after power to mobile device 102 is turned off.

User interface 105 may be housed at least partially within enclosure 101, may be communicatively coupled to controller 103, and may comprise any instrumentality or aggregation of instrumentalities by which a user may interact with mobile device 102. For example, user interface 105 may permit a user to input data and/or instructions into mobile device 102 (e.g., via a keypad and/or touch screen), and/or otherwise manipulate mobile device 102 and its associated components. User interface 105 may also permit mobile device 102 to communicate data to a user, e.g., by way of a display device.

Microphone 106 may be housed at least partially within enclosure 101, may be communicatively coupled to controller 103, and may comprise any system, device, or apparatus configured to convert sound incident at microphone 106 to an electrical signal that may be processed by controller 103, wherein such sound is converted to an electrical signal using a diaphragm or membrane having an electrical capacitance that varies as based on sonic vibrations received at the diaphragm or membrane. Microphone 106 may include an electrostatic microphone, a condenser microphone, an electret microphone, a microelectromechanical systems (MEMs) microphone, or any other suitable capacitive microphone.

Radio transmitter/receiver 108 may be housed within enclosure 101, may be communicatively coupled to controller 103, and may include any system, device, or apparatus configured to, with the aid of an antenna, generate and transmit radio-frequency signals as well as receive radio-frequency signals and convert the information carried by such received signals into a form usable by controller 103. Radio transmitter/receiver 108 may be configured to transmit and/or receive various types of radio-frequency signals, including without limitation, cellular communications (e.g., 2G, 3G, 4G, LTE, etc.), short-range wireless communications (e.g., BLUETOOTH), commercial radio signals, television signals, satellite radio signals (e.g., GPS), Wireless Fidelity, etc.

Mechanical transducer 110 may be housed at least partially within enclosure 101 or may be external to enclosure 101, may be communicatively coupled to controller 103 (e.g., via amplifier 112), and may comprise any system, device, or apparatus made with one or more materials configured to generate electric potential or voltage when mechanical strain is applied to mechanical transducer 110, or conversely to undergo mechanical displacement or change in size or shape (e.g., change dimensions along a particular plane) when a voltage is applied to mechanical transducer 110. In some embodiments, a mechanical transducer may comprise a piezoelectric transducer made with one or more materials configured to, in accordance with the piezoelectric effect, generate electric potential or voltage when mechanical strain is applied to mechanical transducer 110, or conversely to undergo mechanical displacement or change in size or shape (e.g., change dimensions along a particular plane) when a voltage is applied to mechanical transducer 110.

Integrated temperature sensor 114 may comprise any system, device, or apparatus (e.g., a thermometer, thermistor, etc.) configured to communicate a signal to controller 103 or another controller indicative of a temperature within mechanical transducer 110. Accordingly, integrated temperature sensor 114 may be formed within mechanical transducer 110 as described in greater detail below.

Although specific example components are depicted above in FIG. 1A as being integral to mobile device 102 (e.g., controller 103, memory 104, user interface 105, microphone 106, radio transmitter/receiver 108, mechanical transducer 110, amplifier 112, and integrated temperature sensor 114), a mobile device 102 in accordance with this disclosure may comprise one or more components not specifically enumerated above. In addition, although controller 103 and amplifier 112 are shown as separate components in FIG. 1A, in some embodiments, controller 103 and amplifier 112 may be formed on the same integrated circuit or module.

Figure 1B:
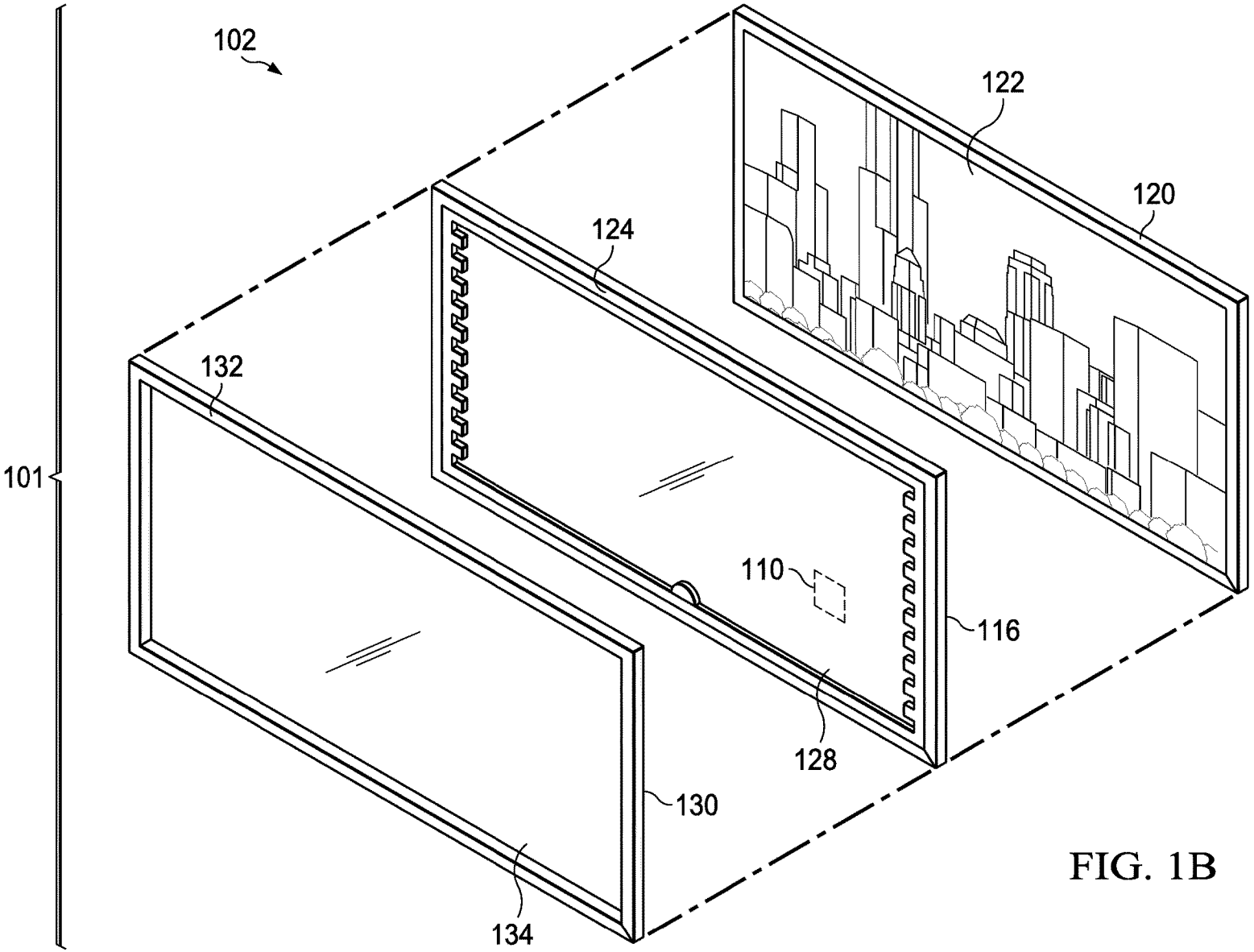
FIG. 1B illustrates an exploded perspective view of selected components of an example mobile device, in accordance with embodiments of the present disclosure.

FIG. 1B illustrates an exploded perspective view of selected components of example mobile device 102, in accordance with embodiments of the present disclosure. As shown in FIG. 1B, enclosure 101 may include a main body 120, a mechanical transducer assembly 116, and a cover assembly 130, such that when constructed, mechanical transducer assembly 116 is interfaced between main body 120 and cover assembly 130. Main body 120 may house a number of electronics, including controller 103, memory 104, radio transmitter/receiver 108, and/or microphone 106, as well as a display (e.g., a liquid crystal display) of user interface 105.

Mechanical transducer assembly 116 may comprise a frame 124 configured to hold and provide mechanical structure for one or more mechanical transducers 110 (which may be coupled to controller 103) and transparent film 128.

Cover assembly 130 may comprise a frame 132 configured to hold and provide mechanical structure for cover 134. Cover 134 may be made from any suitable material (e.g., ceramic) that allows visibility through cover 134 (e.g., which may be transparent), protection of mechanical transducer 110 and display 122, and/or user interaction with display 122.

Although FIG. 1B illustrates mechanical transducer assembly 116 being situated between cover assembly 130 and display 122, in some embodiments, mechanical transducer assembly 116 may reside "behind" display 122, such that display 122 is situated between cover 130 and mechanical transducer assembly 116. In addition, although FIG. 1B illustrates mechanical transducer 110 located at particular locations within mechanical transducer assembly 116, mechanical transducer 110 may be located at any suitable location below cover 134 and/or display 122 (e.g., underneath cover 134 and/or display 122 from a perspective of a user viewing display 122).

In addition, although FIG. 1B depicts mechanical transducer 110 present within mechanical transducer assembly 116 and capable of inducing vibration on cover 130 or display 122, in some embodiments, mechanical transducer 110 may be placed proximate to main body 120 and may be capable of causing a suitable surface of main body 120 to vibrate in order to generate sound.

Although FIGS. 1A and 1B depict only a single mechanical transducer 110, mobile device 102 may include any suitable number of mechanical transducers 110.

Mechanical transducers, including piezoelectric transducers and coil-based dynamic transducers, are typically used to convert electric signals into mechanical force. Thus, when used in connection with display 122, cover 134, and/or main body 120, one or more mechanical transducers 110 may cause vibration on a surface, which in turn may produce pressure waves in air, generating human-audible sound. Accordingly, in operation of mobile device 102, one or more mechanical transducers 110 may be driven by respective amplifiers 112 under the control of controller 103 in order to generate acoustical sound by vibrating the surface of display 122, cover 134, and/or main body 120.

Figure 2A:
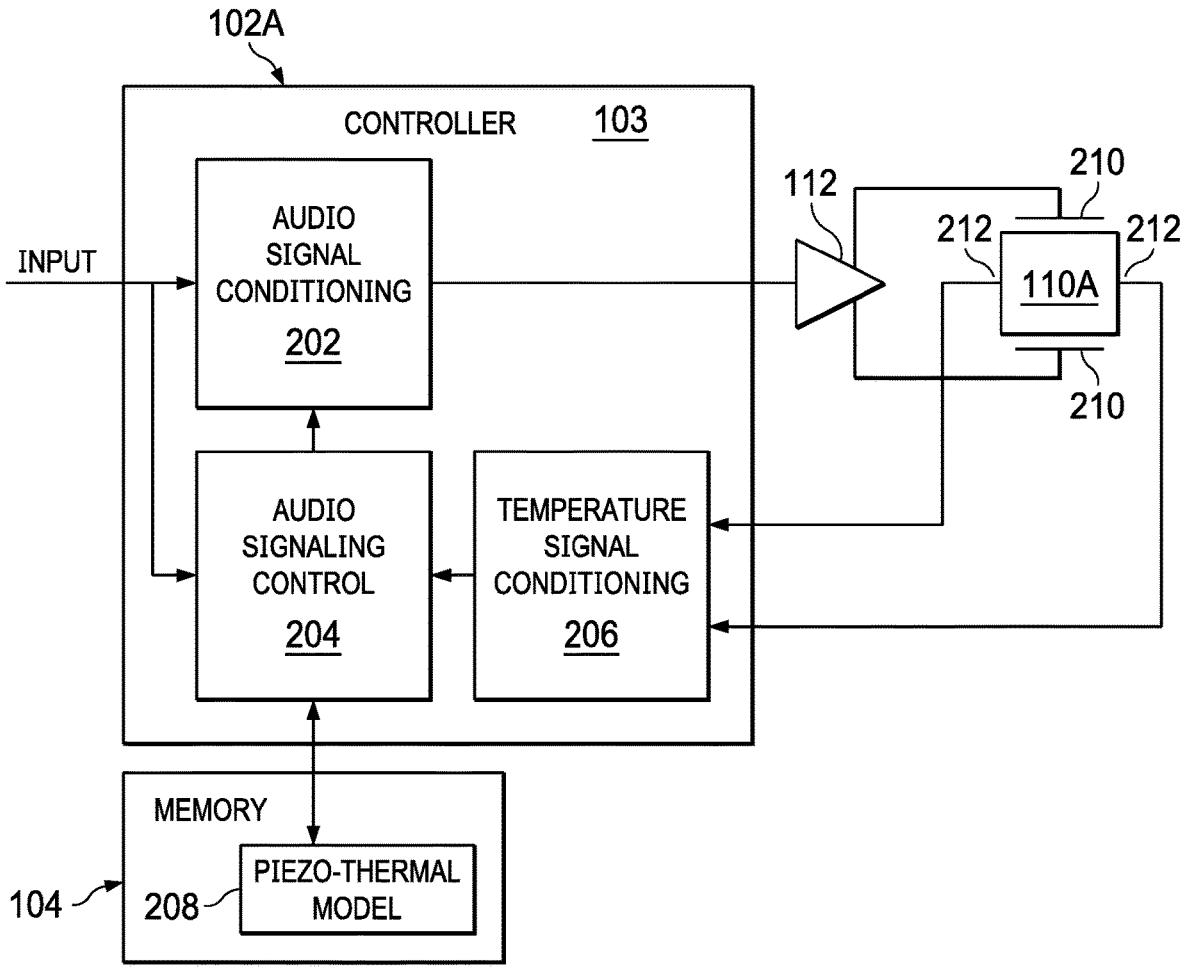
FIG. 2A illustrates selected portions of a mobile device including detail of selected components of a controller, in accordance with embodiments of the present disclosure.

FIG. 2A illustrates selected portions of a mobile device 102A including detail of selected components of controller 103, in accordance with embodiments of the present disclosure. In some embodiments, mobile device 102A may implement mobile device 102 depicted in FIGS. 1A and 1B. As shown in FIG. 2A, mobile device 102A may include piezoelectric transducer 110A which may implement mechanical transducer 110 depicted in FIGS. 1A and 1B.

As also shown in FIG. 2A, controller 103 may implement an audio signal conditioning block 202, an audio signal control block 204, and a temperature signal conditioning block 206. Audio signal conditioning block 202 may include any subsystem or device configured to receive an input signal INPUT and condition input signal INPUT for receipt at the input of amplifier 112, wherein such conditioning is controlled by audio signal control block 204. For example, in some embodiments, such conditioning may include applying a low-pass filter to input signal INPUT, as described in greater detail below. As another example, such conditioning may include applying an equalization filter to input signal INPUT, as described in greater detail below.

Audio signal control block 204 may include any subsystem or device configured to receive from temperature signal conditioning block 206 a temperature signal indicative of a temperature internal to piezoelectric transducer 110A. Based on such temperature signal, audio signal control block 204 may generate and communicate one or more control signals to audio signal conditioning block 202 for controlling operation of audio signal conditioning block 202. For example, when conditioning of audio signal conditioning block 202 applies a low-pass filter to input signal INPUT, audio signal control block 204 may generate and communicate one or more control signals to audio signal conditioning block 202 to control a cutoff frequency of such low-pass filter as a function of temperature, in order to prevent self-heating of piezoelectric transducer 110A that may be more prevalent at higher signal frequencies. As another example, when conditioning of audio signal conditioning block 202 applies an equalization filter to input signal INPUT, audio signal control block 204 may generate and communicate one or more control signals to audio signal conditioning block 202 to control equalization filter coefficients, to equalize variations that may occur in a transfer function of piezoelectric transducer 110A due to changes in temperature. In such a scenario, audio signal control block 204 may access a piezo-thermal model 208 from memory 104 that sets forth operational parameters (e.g., frequency response) of piezoelectric transducer 110A as a function of temperature, such that audio signal control block 204 may generate and communicate control signals to audio signal conditioning block 202 in accordance with a piezo-thermal model 208 of piezoelectric transducer 110A at the sensed temperature.

As shown in FIG. 2A, amplifier 112 may drive driving terminals 210 of piezoelectric transducer 110A in order to cause mechanical vibration of piezoelectric transducer 110A. In addition to driving terminals 210, piezoelectric transducer 110A may include sense terminals 212 of an integrated temperature sensor 114 (not explicitly shown in FIG. 2A) such that a sensed signal at sense terminals 212 (e.g., a voltage between sense terminals 212) may be indicative of a temperature internal to piezoelectric transducer 110A. Temperature signal conditioning block 206 may receive such sensed signal and perform conditioning on the signal (e.g., filtering, analog-to-digital conversion, etc.) to generate and communicate the temperature signal to audio signal control block 204.

Figure 2B:
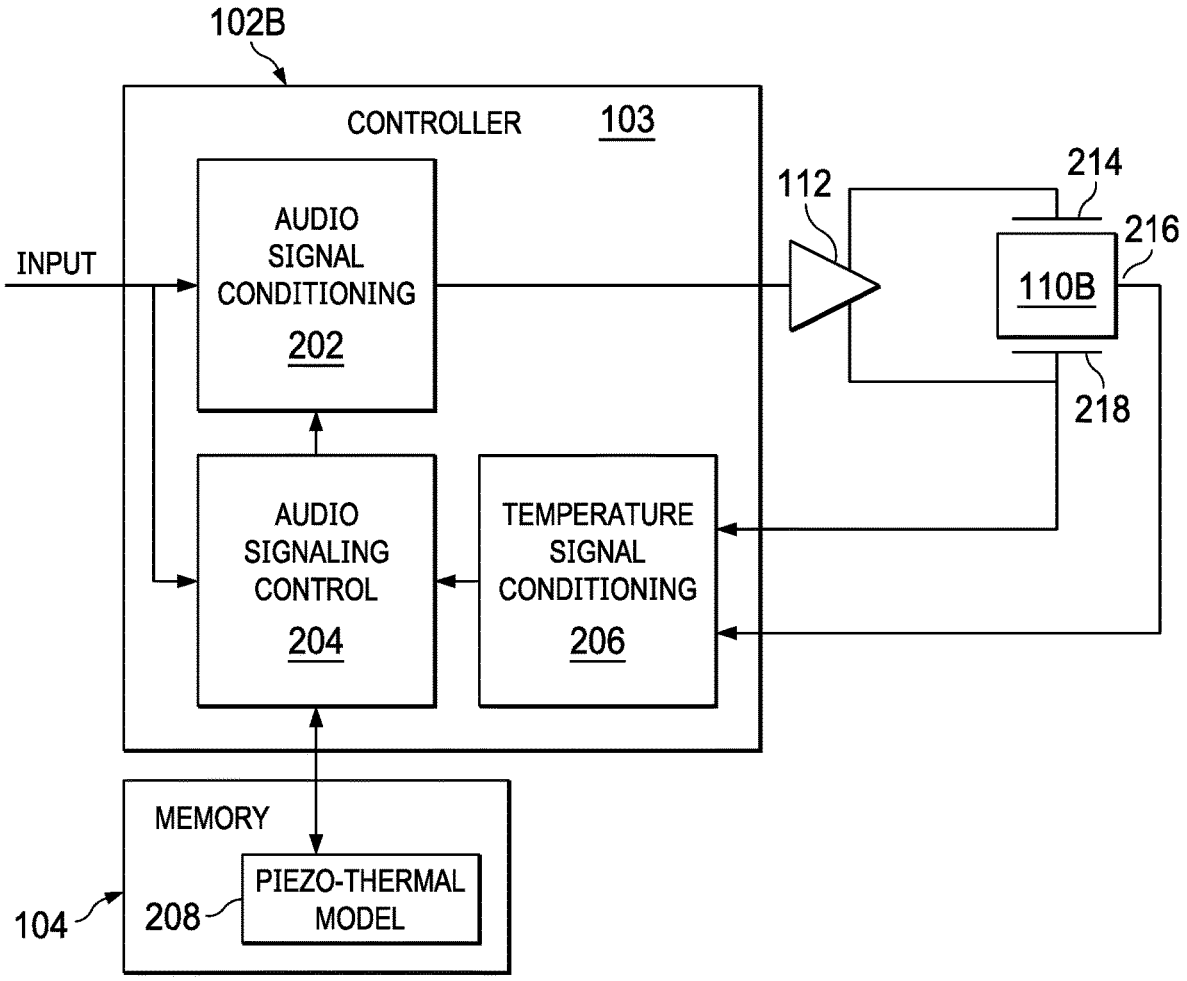
FIG. 2B illustrates selected portions of another mobile device including detail of selected components of a controller, in accordance with embodiments of the present disclosure.

FIG. 2B illustrates selected portions of a mobile device 102B including detail of selected components of controller 103, in accordance with embodiments of the present disclosure. In some embodiments, mobile device 102B may implement mobile device 102 depicted in FIGS. 1A and 1B. Mobile device 102B of FIG. 2B may be similar in many respects to mobile device 102A of FIG. 2A, and thus, only the main differences between mobile device 102B of FIG. 2B and mobile device 102A of FIG. 2A may be discussed below. One main difference between mobile device 102B of FIG. 2B and mobile device 102A of FIG. 2A is that mobile device 102B may include piezoelectric transducer 110B in lieu of piezoelectric transducer 110A. Piezoelectric transducer 110B may implement mechanical transducer 110 depicted in FIGS. 1A and 1B.

As opposed to having four terminals (e.g., two driving terminals 210 and two sense terminals 212) as is the case of piezoelectric transducer 110A, piezoelectric transducer 110B may include three terminals: a driving terminal 214, a sense terminal 216, and a common driving/sense terminal 218. In operation, amplifier 112 may drive a driving signal to driving terminal 214 and common driving/sense terminal 218 to induce mechanical vibration of piezoelectric transducer 110B, and temperature signal conditioning block 206 may sense a sensed signal at sense terminal 216 and common driving/sense terminal 218 (e.g., a voltage between sense terminal 216 and common driving/sense terminal 218) which may be indicative of a temperature internal to piezoelectric transducer 110B. Because common driving/sense terminal 218 is driven by amplifier 112, temperature signal conditioning block 206 may need to filter out or otherwise remove a common-mode signal present at each of sense terminal 216 and common driving/sense terminal 218 in order to determine the component of the sensed signal indicative of temperature.

Figure 3A:
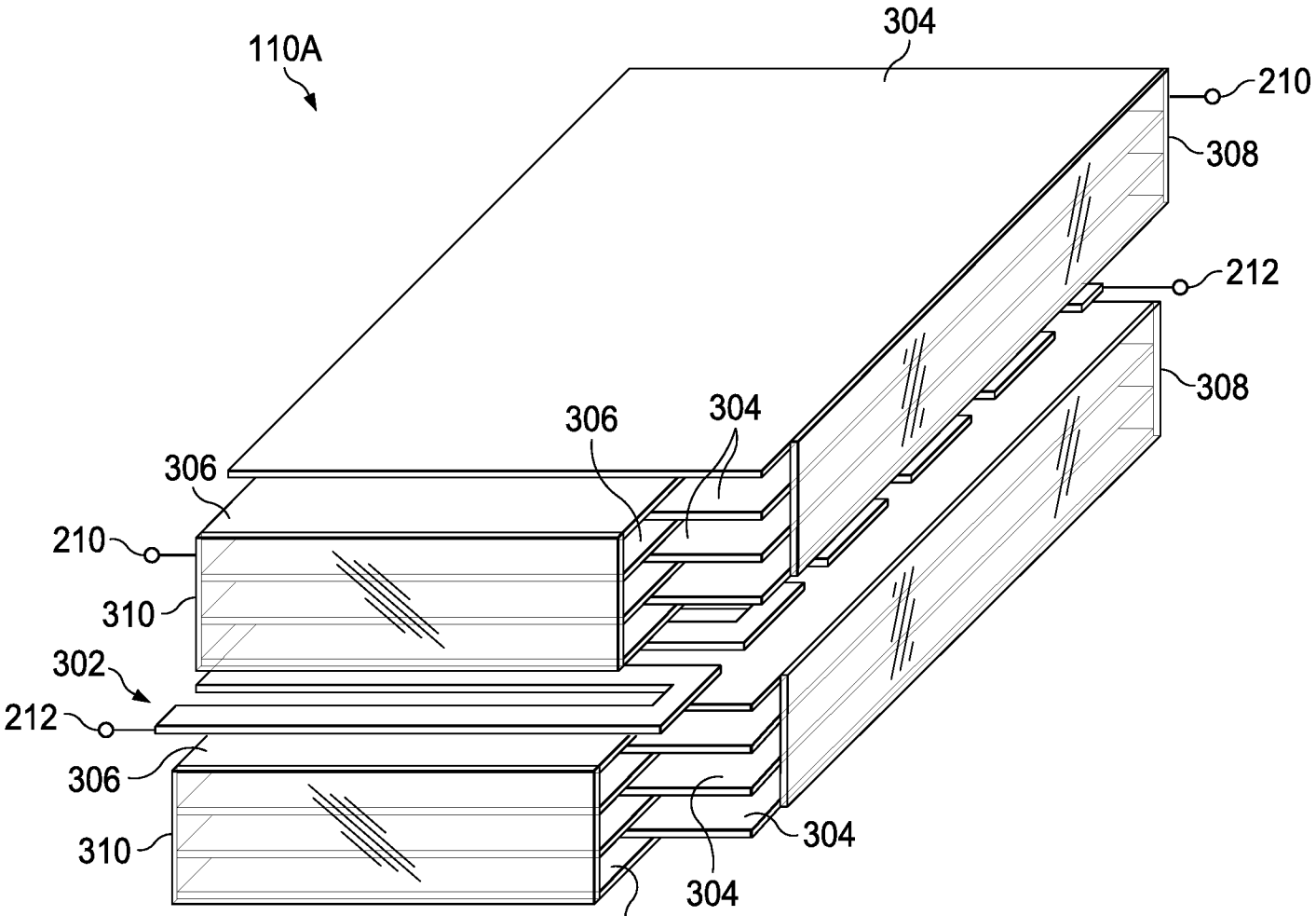
FIG. 3A illustrates an isometric perspective view of a piezoelectric transducer comprising an integrated temperature sensor, in accordance with embodiments of the present disclosure.

FIG. 3A illustrates a partially-exploded isometric perspective view of piezoelectric transducer 110A comprising an integrated temperature sensor, in accordance with embodiments of the present disclosure. As shown in FIG. 3A, piezoelectric transducer 110A may be formed by interleaving a plurality of layers of piezoelectric material (not explicitly shown in FIG. 3A for purposes of clarity and exposition) with a plurality of conductive layers including a first conductive layer 302, one or more second conductive layers 304, and one or more third conductive layers 306. First conductive layer 302 may be coupled to sense terminals (e.g., electrodes) 212 and may have an electrical impedance that varies as a function of a temperature internal to the piezoelectric transducer. Accordingly, first conductive layer 302 may implement integrated temperature sensor 114 as it may generate a measurement signal indicative of its electrical impedance, which in turn is indicative of its temperature. As shown in FIG. 3A, the one or more second conductive layers 304 may be electrically coupled to one another via conductive terminations 308, and conductive terminations 308 may be electrically coupled to one another when piezoelectric transducer 110A is fully assembled. One or more of conductive terminations 308 may be coupled to a first one of driving terminals (e.g., an electrode) 210. Similarly, the one or more third conductive layers 306 may be electrically coupled to one another via conductive terminations 310, and conductive terminations 310 may be electrically coupled to one another when piezoelectric transducer 110A is fully assembled. One or more of conductive terminations 310 may be coupled to a second one of driving terminals (e.g., an electrode) 210. Accordingly, an electrical driving signal driven to driving terminals 210 may cause mechanical vibration of piezoelectric transducer 110A as a function of the electrical driving signal. When piezoelectric transducer 110A is fully formed, first conductive layer 302 may be electrically isolated from both of second conductive layers 304 and third conductive layers 306.

Figure 3B:
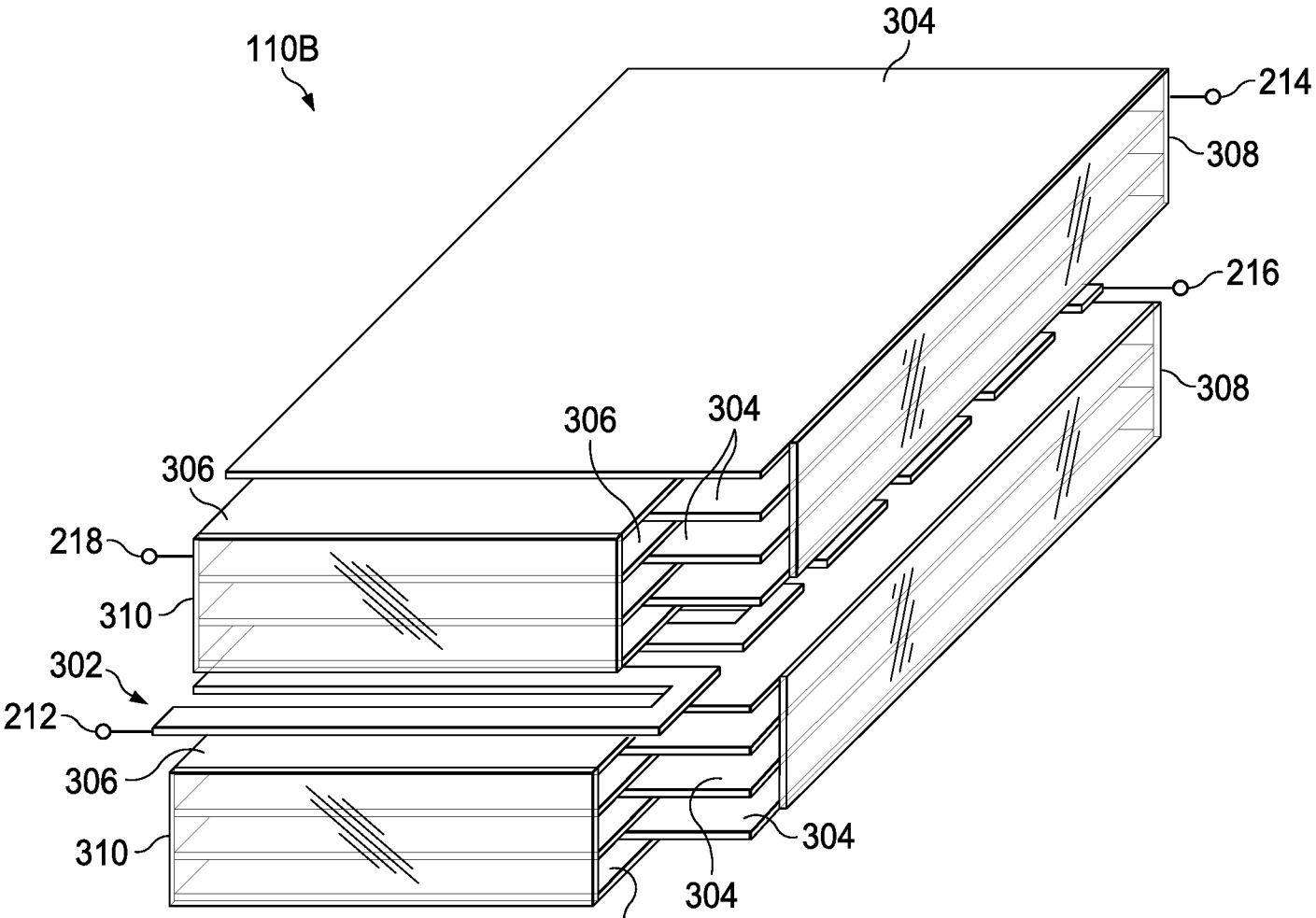
FIG. 3B illustrates an isometric perspective view of another piezoelectric transducer comprising an integrated temperature sensor, in accordance with embodiments of the present disclosure.

FIG. 3B illustrates a partially-exploded isometric perspective view of piezoelectric transducer 110B comprising an integrated temperature sensor, in accordance with embodiments of the present disclosure. Formation of piezoelectric transducer 110B in FIG. 3B may be similar in many respects to formation of piezoelectric transducer 110A in FIG. 3A, and thus, only the main differences between formation of piezoelectric transducer 110A in FIG. 3A and of piezoelectric transducer 110B in FIG. 3B may be discussed below. One of the key difference between piezoelectric transducer 110A and piezoelectric transducer 110B is that first conductive layer 302 may be electrically coupled to third conductive layers 306 (e.g., first conductive layer 302 may be electrically coupled to conductive terminations 310). However, first conductive layer 302 may be electrically isolated from second conductive layer 304. In addition, one or more of conductive terminations 308 may be electrically coupled to driving terminal (e.g., an electrode) 214, first conductive layer 302 may be electrically coupled to sense terminal (e.g., an electrode) 216, and one or more of conductive terminations 308 and first conductive layer 302 may be electrically coupled to common driving/sense terminal (e.g., an electrode) 218. In other words, in FIG. 3, a thermal sensor implemented with first conductive layer 302 may have one of its terminals coupled to a driving terminal of piezoelectric transducer 110B. Accordingly, an electrical driving signal driven to driving terminal 214 and common driving/sense terminal 218 may cause mechanical vibration of piezoelectric transducer 110B as a function of the electrical driving signal. Further, a measurement signal indicative of an electrical impedance of first conductive layer 302 (and thus a temperature internal to piezoelectric transducer 110B) may be sensed between sense terminal 216 and common driving/sense terminal 218 (e.g., by appropriately removing common-mode components induced by the electrical driving signal).

Figure 4:
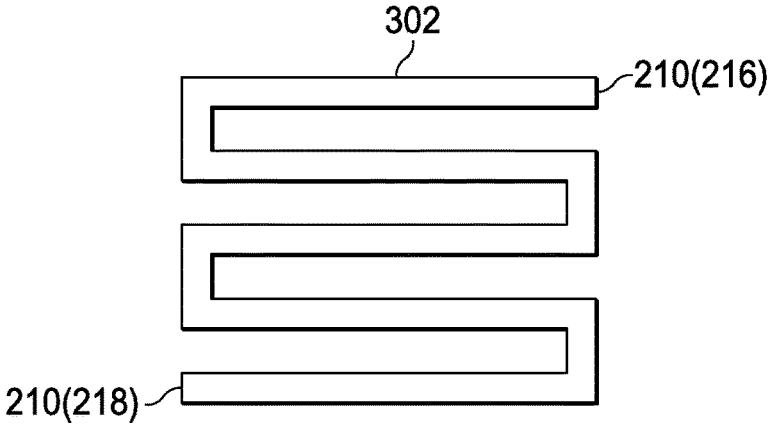
FIG. 4 illustrates a top-down cross-sectional plan view of a first conductive layer, in accordance with embodiments of the present disclosure.

In some embodiments, first conductive layer 302 may be formed by patterning first conductive layer 302 such that first conductive layer 302 has a significantly higher electrical impedance than each of second conductive layers 304 and third conductive layers 306. For example, FIG. 4 illustrates a top-down cross-sectional plan view of a first conductive layer 302, in accordance with embodiments of the present disclosure. As shown in FIG. 4, metal layer 302 may be patterned in a manner to maximize the electrical impedance present between the respective terminals 210 (or 216 and 218) of metal layer 302. In some embodiments, first conductive layer 302 may be a material having a higher electrical resistivity than that of the material(s) comprising second conductive layers 304 and third conductive layers 306.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. A method comprising:

receiving a measurement signal indicative of a temperature internal to a piezoelectric transducer from a first electrode coupled to a first conductive layer of the piezoelectric transducer, wherein the piezoelectric transducer comprises a plurality of layers of piezoelectric material interleaved with a plurality of conductive layers including the first conductive layer, one or more second conductive layers coupled to a second electrode, and one or more third conductive layers coupled to a third electrode wherein an electrical driving signal driven to the second electrode and the third electrode causes mechanical vibration of the piezoelectric transducer as a function of the electrical driving signal; and controlling the electrical driving signal in order to maintain the temperature internal to the piezoelectric transducer at a desired temperature or desired temperature range.

2. The method of claim 1, wherein receiving the measurement signal comprises receiving a differential measurement signal indicative of the electrical impedance from the first electrode and the second electrode.

3. The method of claim 1, wherein receiving the measurement signal comprises receiving a differential measurement signal indicative of the electrical impedance from the first electrode and a fourth electrode coupled to the first conductive layer.

4. The method of claim 1, wherein the first conductive layer is patterned such that the first conductive layer has a significantly higher electrical impedance than each of the conductive layers of the one or more second conductive layers and the one or more third conductive layers.

5. The method of claim 1, wherein controlling the electrical driving signal comprises controlling a cutoff frequency of a low-pass filter from which the electrical driving signal is generated.

6. The method of claim 1, wherein controlling the electrical driving signal comprises controlling one or more equalization coefficients of an equalization filter from which the electrical driving signal is generated.

7. The method of claim 6, wherein controlling one or more equalization coefficients comprises:

accessing a piezo-thermal model that sets forth operation of the piezoelectric transducer as a function of temperature; and generating the one or more equalization coefficients in accordance with the piezo-thermal model at a sensed temperature.

8. A system comprising:

an input configured to receive a measurement signal indicative of a temperature internal to a piezoelectric transducer from a first electrode coupled to a first conductive layer of the piezoelectric transducer, wherein the piezoelectric transducer comprises a plurality of layers of piezoelectric material interleaved with a plurality of conductive layers including the first conductive layer, one or more second conductive layers coupled to a second electrode, and one or more third conductive layers coupled to a third electrode wherein an electrical driving signal driven to the second electrode and the third electrode causes mechanical vibration of the piezoelectric transducer as a function of the electrical driving signal; and control circuitry configured to control the electrical driving signal in order to maintain the temperature internal to the piezoelectric transducer at a desired temperature or desired temperature range.

9. The system of claim 8, wherein the measurement signal comprises a differential measurement signal indicative of the electrical impedance from the first electrode and the second electrode.

10. The system of claim 8, wherein the measurement signal comprises a differential measurement signal indicative of the electrical impedance from the first electrode and a fourth electrode coupled to the first conductive layer.

11. The system of claim 8, wherein the first conductive layer is patterned such that the first conductive layer has a significantly higher electrical impedance than each of the conductive layers of the one or more second conductive layers and the one or more third conductive layers.

12. The system of claim 8, wherein controlling the electrical driving signal comprises controlling a cutoff frequency of a low-pass filter from which the electrical driving signal is generated.

13. The system of claim 8, wherein controlling the electrical driving signal comprises controlling one or more equalization coefficients of an equalization filter from which the electrical driving signal is generated.

14. The system of claim 13, wherein controlling one or more equalization coefficients comprises:

accessing a piezo-thermal model that sets forth operation of the piezoelectric transducer as a function of temperature; and generating the one or more equalization coefficients in accordance with the piezo-thermal model at a sensed temperature.

15. A device comprising:

a piezoelectric transducer; and control circuitry configured to:

receive a measurement signal indicative of a temperature internal to a piezoelectric transducer from a first electrode coupled to a first conductive layer of the piezoelectric transducer, wherein the piezoelectric transducer comprises a plurality of layers of piezoelectric material interleaved with a plurality of conductive layers including the first conductive layer, one or more second conductive layers coupled to a second electrode, and one or more third conductive layers coupled to a third electrode, wherein an electrical driving signal driven to the second electrode and the third electrode causes mechanical vibration of the piezoelectric transducer as a function of the electrical driving signal; and control the electrical driving signal in order to maintain the temperature internal to the piezoelectric transducer at a desired temperature or desired temperature range.

16. The device of claim 15, wherein the measurement signal comprises a differential measurement signal indicative of the electrical impedance from the first electrode and the second electrode.

17. The device of claim 15, wherein the measurement signal comprises a differential measurement signal indicative of the electrical impedance from the first electrode and a fourth electrode coupled to the first conductive layer.

18. The device of claim 15, wherein the first conductive layer is patterned such that the first conductive layer has a significantly higher electrical impedance than each of the conductive layers of the one or more second conductive layers and the one or more third conductive layers.

19. The device of claim 15, wherein controlling the electrical driving signal comprises controlling a cutoff frequency of a low-pass filter from which the electrical driving signal is generated.

20. The device of claim 15, wherein controlling the electrical driving signal comprises controlling one or more equalization coefficients of an equalization filter from which the electrical driving signal is generated.

21. The device of claim 20, wherein controlling one or more equalization coefficients comprises:

accessing a piezo-thermal model that sets forth operation of the piezoelectric transducer as a function of temperature; and generating the one or more equalization coefficients in accordance with the piezo-thermal model at a sensed temperature.

* * * * *